US009657603B2

(12) United States Patent
Grelet

(10) Patent No.: US 9,657,603 B2
(45) Date of Patent: May 23, 2017

(54) INTERNAL COMBUSTION ENGINE ARRANGEMENT COMPRISING A WASTE HEAT RECOVERY SYSTEM AND PROCESS FOR CONTROLLING SAID SYSTEM

(71) Applicant: VOLVO TRUCK CORPORATION, Göteborg (SE)

(72) Inventor: Vincent Grelet, Lyons (FR)

(73) Assignee: Volvo Truck Corporation, Göteborg (SE)

( * ) Notice: Subject to any disclaimer, the term of this patent is extended or adjusted under 35 U.S.C. 154(b) by 0 days.

(21) Appl. No.: 14/893,943

(22) PCT Filed: Jul. 15, 2013

(86) PCT No.: PCT/IB2013/002049
§ 371 (c)(1),
(2) Date: Nov. 25, 2015

(87) PCT Pub. No.: WO2015/008107
PCT Pub. Date: Jan. 22, 2015

(65) Prior Publication Data
US 2016/0130981 A1 May 12, 2016

(51) Int. Cl.
*F01N 3/18* (2006.01)
*F01K 23/06* (2006.01)
*F01K 23/10* (2006.01)

(52) U.S. Cl.
CPC ..... *F01K 23/065* (2013.01); *F01K 23/10* (2013.01)

(58) Field of Classification Search
CPC ..... F01K 23/065; F01K 23/10
(Continued)

(56) References Cited

U.S. PATENT DOCUMENTS

2010/0146947 A1* 6/2010 Liu ..... C01B 3/26 60/295
2010/0199631 A1* 8/2010 Vilimec ..... F01K 21/045 60/39.182
(Continued)

FOREIGN PATENT DOCUMENTS

DE 102009056822 B3 12/2010
JP 58189494 12/1983
(Continued)

OTHER PUBLICATIONS

International Search Report (May 8, 2014) for corresponding International App. PCT/IB2013/002049.
(Continued)

*Primary Examiner* — Nicholas J Weiss
*Assistant Examiner* — Dapinder Singh
(74) *Attorney, Agent, or Firm* — WRB-IP LLP

(57) ABSTRACT

A waste heat recovery system carrying a working fluid in a loop includes an expander, a condenser and a pump, a first and a second line arranged in parallel in the high pressure circuit portion upstream of the expander and joining at a downstream junction point in the high pressure circuit portion. The first line includes a first heat exchanger connected to the exhaust line, and the second line includes a second heat exchanger connected to a line carrying a warm fluid. A first by-pass system prevents not fully evaporated working fluid from the first line to flow through the expander. A second by-pass system connects the second line to the low pressure circuit portion for by-passing the downstream junction point and the expander.

28 Claims, 5 Drawing Sheets

(58) Field of Classification Search
USPC ..... 60/616, 618
See application file for complete search history.

(56) References Cited

U.S. PATENT DOCUMENTS

| | | | | |
|---|---|---|---|---|
| 2011/0072816 | A1* | 3/2011 | Ernst | F01K 23/065 60/616 |
| 2013/0199178 | A1* | 8/2013 | Kanou | F01K 7/22 60/605.2 |

FOREIGN PATENT DOCUMENTS

| | | | |
|---|---|---|---|
| JP | 2008-128254 | | 6/2008 |
| JP | 2011149432 | | 8/2011 |
| JP | H04194645 | | 1/2013 |
| WO | 2012009526 | A1 | 1/2012 |
| WO | 2012051062 | A2 | 4/2012 |
| WO | 2012061812 | A2 | 5/2012 |

OTHER PUBLICATIONS

Japanese Official Action (translation) (Dec. 21, 2016) for corresponding Japanese App. 2016-526711.

* cited by examiner

INTERNAL COMBUSTION ENGINE ARRANGEMENT COMPRISING A WASTE HEAT RECOVERY SYSTEM AND PROCESS FOR CONTROLLING SAID SYSTEM

BACKGROUND AND SUMMARY

The present invention relates to an internal combustion engine arrangement, and more specifically to such an arrangement comprising a waste heat recovery system.

For many years, attempts have been made to improve the efficiency of internal combustion engines, which has a direct impact on fuel consumption.

For this purpose, an engine can conventionally be equipped with a waste heat recovery system, i.e. a system making use of one or several heat sources produced by the vehicle operation, such as the hot exhaust gases which contain a lot of thermal energy that would otherwise be lost. Such a waste heat recovery system converts the heat energy into mechanical or electrical or physical energy or power. Some waste heat recovery systems operate thanks to a working fluid, distinct from the exhaust gases, which is heated by the exhaust gases, in a heat exchanger, and which is expanded in an expander where part of the energy of the working fluid is converted into mechanical energy.

One example of a waste heat recovery system is a circuit in which a working fluid flowing in a closed loop undergoes the following successive processes:

- the working fluid, which is a liquid at this stage, is pumped from low to high pressure;
- the high pressure liquid working fluid is evaporated in a heat exchanger by means of said heat source;
- the gaseous working fluid is expanded in an expander where the energy of the working fluid is converted into mechanical energy;
- finally, the gaseous working fluid is condensed.

As a result, at least part of the thermal energy of the heat source used to evaporate the working fluid is recovered in the expander.

Such a waste heat recovery system can be, for instance, a Rankine system.

In order to increase the amount of energy that can be recovered, some conventional waste heat recovery systems include two heat exchangers arranged in parallel, namely:

- a first heat exchanger which is arranged in a first line and is thermally connected to the exhaust line;
- and a second heat exchanger which is arranged in a second line and is thermally connected to another line carrying a warm fluid. The warm fluid may be a fluid which is carried towards the engine, such as the EGR (exhaust gas recirculation) gases flowing in an EGR line. The warm fluid may be engine cooling fluid or a gearbox or engine lubricant fluid.

WO 2012/009526 discloses a waste heat recovery system having a first line including a heat exchanger connected to the exhaust line, and a second line, arranged in parallel with the first line, including a heat exchanger connected to an EGR line.

In the case where the warm fluid flows in a closed loop in the engine arrangement, for example towards the engine, it may be advantageous that its temperature at the engine inlet is controlled to ensure the engine is operated efficiently. More specifically, it may be necessary that said temperature must be maintained below a predetermined value which can depend on the warm fluid function.

To that end, in some operating conditions in which said temperature of the warm fluid can be fairly high, the flow rate of the working fluid in the second line can be increased in order to provide more cooling capacity. However, as a result, the working fluid which exits the second heat exchanger may not be fully evaporated. Therefore, there is a risk that the working fluid, at the expander inlet, might still contain liquid, which could seriously damage the expander.

Several solutions are known to solve the above problem resulting from the coexistence of two contradictory constraints.

A solution consists in providing an additional cooler on the additional fluid line carrying the warm fluid, between the second heat exchanger and the engine. This solution is costly and may be not easy to implement because of the lack of space available to install additional components.

It is also known to provide a bypass of the expander. In this way, the expander can be by-passed when necessary, i.e. when the working fluid at the expander inlet is not fully gaseous. Although this solution solves the above mentioned problem, it is not fully satisfactory. Indeed, it implies that, in case the working fluid from the second line is not fully evaporated, no working fluid at all can flow through the expander. However, there are some operating conditions in which the working fluid from the first line can be fully evaporated whereas the working fluid from the second line is not. In such a case, no energy can be recovered at the expander when it could have been partly possible.

It therefore appears that engine arrangements comprising a waste heat recovery system are not fully satisfactory and could be improved.

It is desirable to provide an improved internal combustion engine arrangement comprising a waste heat recovery system which can overcome the drawbacks of the prior art engine arrangements.

It is desirable to provide such an engine arrangement which makes it possible to more efficiently use the thermal energy from both heat sources without impairing the engine arrangement overall efficiency nor damaging the expander.

According to a first aspect, the invention relates to an internal combustion engine arrangement which comprises:

- an internal combustion engine;
- an exhaust line capable of collecting exhaust gases from the engine;
- an additional fluid line, distinct from the exhaust line, carrying a warm fluid;
- a waste heat recovery system carrying a working fluid in a closed loop, in which said working fluid is successively pressurized from a low pressure circuit portion to a high pressure circuit portion by a pump, evaporated in the high pressure circuit portion, expanded in an expander from the high pressure circuit portion to a low pressure circuit portion, and condensed in a condenser in the low pressure circuit portion.

This waste heat recovery system comprises a first and a second lines arranged in parallel in the high pressure circuit portion upstream of the expander, the first and second lines joining at a downstream junction point in the high pressure circuit portion upstream of the expander, wherein the first line comprises a first heat exchanger thermally connected to the exhaust line, in which the working fluid can be heated by means of the exhaust gases, and the second line comprises a second heat exchanger thermally connected to the additional fluid line, in which the working fluid can be evaporated by means of the warm fluid.

According to the invention, the internal combustion engine arrangement further comprises:

a first by-pass system designed to prevent not fully evaporated working fluid from the first line to flow through the expander;

a second by-pass system which connects the second line upstream of the downstream junction point, to the low pressure circuit portion, at a connecting point, for by-passing the downstream junction point and the expander.

Thus, owing to the provision of two by-pass systems, the invention allows to make use of the working fluid from the first line to recover energy at the expander, any time it is possible, even if the working fluid from the second line cannot be used because it is not fully evaporated.

In other words, in contrast with the prior art, the invention provides two by-pass systems which can be fully or at least partly distinct, rather than one single and global by-pass system. As a result, the second by-pass system can be used independently of the first by-pass system, resulting in working fluid still flowing towards the expander from the first line.

With the invention, it is possible to make sure that only fully evaporated working fluid, or working fluid under superheated vapour form (i.e. at a temperature higher than its boiling temperature) can enter the expander to ensure a proper operation of the expander and prevent damaging it.

It has to be noted that, in embodiments where the two by-pass systems have some common parts, the first by-pass system might also prevent underheated working fluid from the second line to flow through the expander.

In practice, the first and second lines can be arranged in parallel between an upstream junction point to a downstream junction point. The upstream junction point can be located:

either in the high pressure circuit portion, i.e. downstream from the pump. Then, the first and a second lines are arranged in parallel between the pump and the expander, and a single pump can be provided;

or in the low pressure circuit portion. In this configuration, there may be provided one pump for each of the first and second lines, the upstream junction point being located upstream from the pumps.

As regards the second by-pass system, it can connect a point of the second line located upstream of the downstream junction point and downstream of the second heat exchanger to the connecting point.

According to an implementation of the invention, the second bypass system can comprise at least one by-pass valve which may be arranged in the second line between the second heat exchanger and the downstream junction point and which may be configured for directing the flow of working fluid from the second heat exchanger either through the second line to the downstream junction point, or to the low pressure circuit portion.

For example, the second bypass system can be connected to the low pressure circuit portion upstream of the condenser.

The second bypass system can comprise a secondary line which by-passes the expander and connects the second line upstream of the downstream junction point to a connecting point located in the low pressure circuit portion between the expander and the condenser. As the secondary line by-passes the expander, it may have no common parts with the high pressure circuit portion and low pressure circuit portion.

According to an implementation of the invention, the engine arrangement comprises a determining device for determining at least one physical parameter of the working fluid in the second line, and a control unit operatively connected to the determining device for controlling the by-pass valve as a function of said physical parameter(s).

The physical parameter(s) can for example be determined in the second line, between the second heat exchanger and the downstream junction point.

The physical parameters are preferably those parameters allowing to determine whether the working fluid is fully evaporated or not, or allowing to determine the liquid content of the fluid. Said parameters can include temperature, pressure and flow rate.

The physical parameters, can either be measured by one or several dedicated sensors, or calculated using other values measured in the engine arrangement. Therefore, the second by-pass system can be activated when required, as a function of said physical parameters, eventually among other parameters.

In practice, if the working fluid is determined to be in a fully evaporated or superheated vapour state, the working fluid is directed towards the downstream junction point, and thus to the expander. On the contrary, if the working fluid is determined to be in a not fully evaporated state, this may result in the working fluid directed to the connecting point through the by-pass system.

According to an embodiment of the invention, the first by-pass system may comprise a first by-pass line having an inlet located between the first heat exchanger and the expander, and an outlet located in the low pressure circuit portion between the expander and the condenser. In practice, the first by-pass line can have an inlet located between the downstream junction point and the expander. In this embodiment, the first by-pass system allows the working fluid to by-pass the expander.

According to another embodiment of the invention, the first by-pass system may comprise a control valve which is arranged in the first line, upstream from the first heat exchanger, and which is capable of preventing the working fluid from flowing into the first heat exchanger. In this embodiment the first by-pass system allows the working fluid to by-pass the first heat exchanger. The control valve may for example be arranged at an upstream junction point of the first and second lines, thereby allowing regulating the sub flows of working fluid both in the first and second lines.

The engine arrangement may further comprise a control system for controlling the flow rate of working fluid in the second line, in order to regulate the temperature of the warm fluid in the additional fluid line, between the second heat exchanger and the engine.

To that end, according to an embodiment, the control system can comprise an electric motor capable of driving the pump, and a proportional three way valve designed to regulate the sub flow rates of the working fluid in the first and second lines. For example, the proportional three way valve can be located at an upstream junction point of the first and second lines. Providing an electrically driven pump makes it possible to control the global flow rate of working fluid in the loop, while the proportional three way valve makes it possible to control the sub flows of working fluid in the first line and in the second line.

In another embodiment, the pump can be mechanically driven by the internal combustion engine, the control system comprising an additional proportional three way valve located between the pump and the second heat exchanger and having a port connected to the low pressure circuit portion, between the condenser and the pump, through a return line. In this embodiment, the global flow rate of working fluid in the closed loop cannot be regulated. The additional proportional three way valve, by directing the appropriate flow mass of working fluid directly back to the low pressure circuit portion upstream from the pump, possibly in a tank, makes it possible to control the global flow rate of the working fluid. In combination with a proportional three way valve located at an upstream junction point between the first and second lines, the sub flow of working fluid in the second line can be controlled.

According to a second aspect, the invention relates to a process for controlling a waste heat recovery system forming part of an internal combustion engine arrangement. The process comprises:

- collecting exhaust gases from an internal combustion engine in an exhaust line;
- carrying a warm fluid in an additional fluid line, distinct from the exhaust line;
- carrying a working fluid in a closed loop, in which said working fluid is successively pressurized, evaporated, expanded in an expander to convert energy of the working fluid into mechanical energy or power, and condensed, wherein the working fluid is divided into a first flow heated by the exhaust gases and into a separate second flow heated by the warm fluid.

The process can further comprise determining at least one physical parameter of the working fluid in the first flow; and determining at least one physical parameter of the working fluid in the second flow.

According to an embodiment of the invention, if the first fluid flow is determined to be in a first fluid state and the second fluid flow is determined to be in a second fluid state, the process comprises controlling a first bypass system so that the first fluid flow is expanded in the expander and controlling a second bypass system so that the second fluid flow by-passes the expander.

According to another embodiment of the invention, if the first fluid flow is determined to be in a first fluid state and the second fluid flow is determined to be in a second fluid state, the process comprises

- determining if mixing of the first flow with the second flow would result in the resulting mixed flow being in a first state;
- and, if so, controlling a first bypass system and a second bypass system so that the first fluid flow is mixed with the second fluid flow and so that the resulting mixed flow is expanded in the expander.

Furthermore, if the first fluid flow is determined to be in a first fluid state, the process can comprise:

- controlling the first by-pass system so that the first fluid flow bypasses the expander;
- or controlling the first by-pass system so that the flow rate of the first fluid flow is zero. In other words: no working fluid flows through the first heat exchanger.

In practice, the first fluid state can be one of a fully evaporated and a superheated vapour state, while the second fluid state can be a not fully evaporated state.

The invention can provide a process which comprises:

a) determining at least one physical parameter of the working fluid in the first line and, in case said physical parameter indicates that the working fluid in said first line is in a first fluid state—i.e. not fully evaporated or not superheated vapour—preventing said working fluid from flowing through the expander;

b) determining at least one physical parameter of the working fluid in the second line and controlling a second by-pass system which connects the second line upstream of the downstream junction point to the low pressure circuit portion as a function of said physical parameter, so as to direct the flow of working fluid from the second heat exchanger either through the second line to the downstream junction point, or through a secondary line, that is distinct from the common line, to the low pressure circuit portion for by-passing the downstream junction point and the expander.

in order to prevent not fully evaporated working fluid from flowing through the expander.

Actions a) and b) are not successive steps, but actions that can be independently performed in order to avoid that a still partly liquid working fluid enters the expander.

Therefore, as regards action a), having a not fully evaporated working fluid in the first line, downstream of the first expander, will entail the activation of the first by-pass system. As regards action b), the expander is bypassed depending on the physical parameter(s) of the working fluid in the second line, downstream of the second expander, to ensure the working fluid entering the expander will be fully evaporated or superheated vapour.

According to an implementation, in action b), the working fluid can be directed through the secondary line in case it is determined that said working fluid, in the second line, is not fully evaporated.

According to another implementation, in case, in action b), it is determined that said working fluid, in the second line, is not fully evaporated, the process can further comprise:

- determining if the physical parameters of the working fluid in the first line are sufficient to cause the full evaporation of the working fluid from the second line around the downstream junction point;
- and, if so, directing the flow of working fluid from the second heat exchanger through the second line to the downstream junction point.

These and other features and advantages will become apparent upon reading the following description in view of the drawing attached hereto representing, as non-limiting examples, embodiments of a vehicle according to the invention.

BRIEF DESCRIPTION OF THE DRAWINGS

The following detailed description of several embodiments of the invention is better understood when read in conjunction with the appended drawings, it being however understood that the invention is not limited to the specific embodiments disclosed.

DETAILED DESCRIPTION

Figure 1:
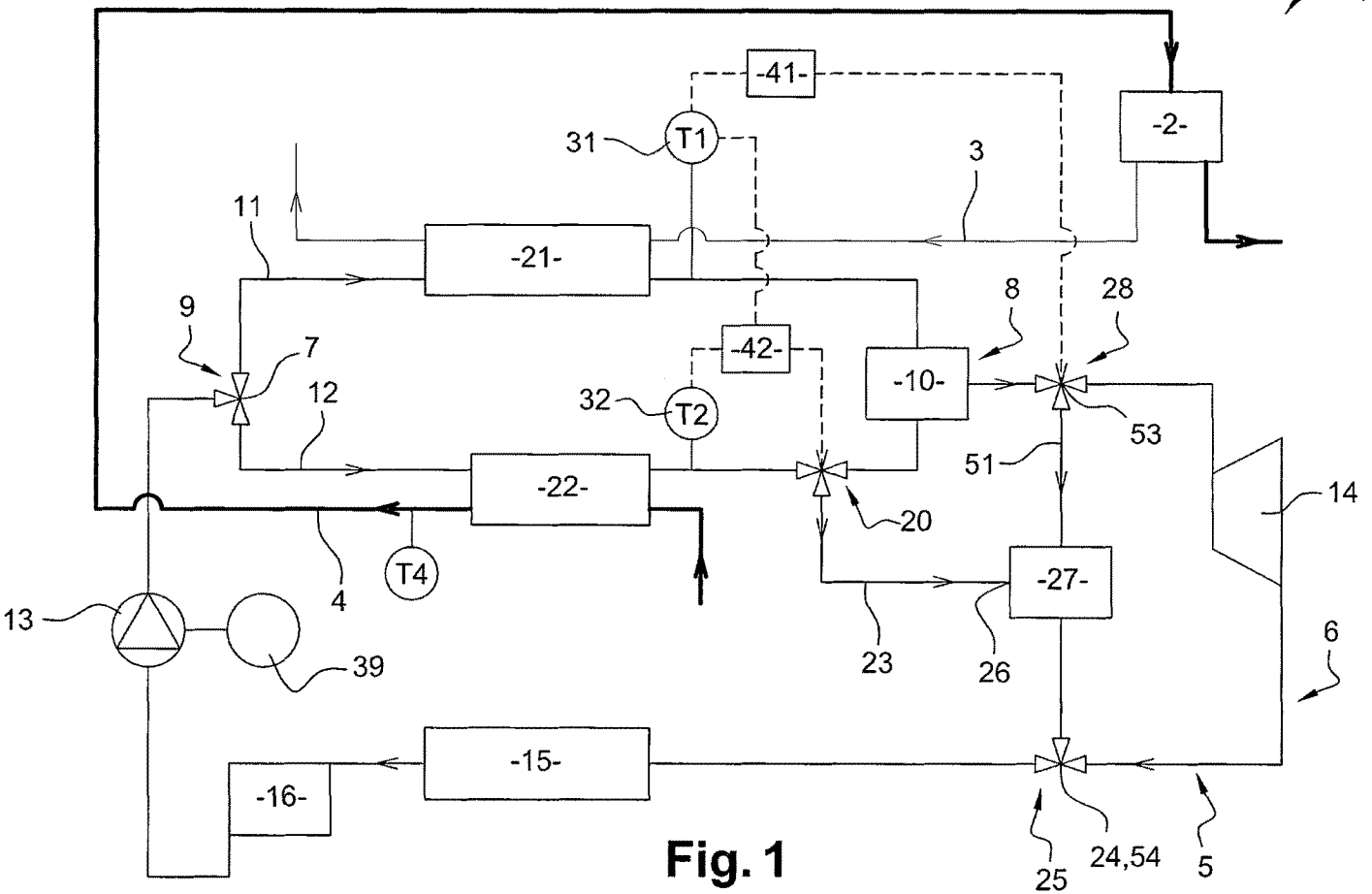
FIG. 1 is a schematic drawing of an of an engine arrangement according to a first embodiment of the invention.

An internal combustion engine arrangement 1 according to the invention comprises an internal combustion engine 2, which can be a diesel engine or a spark ignition engine. The invention relates in particular, but not exclusively, to industrial vehicles.

An exhaust line 3 is provided for collecting exhaust gases from said engine 2 and carrying them towards the atmosphere. The exhaust line may comprise, as a non-limited list of examples, an exhaust manifold, one or several exhaust conduit portions, one or several turbocharger turbines, filters, catalysts, which are flown through by the exhaust gases before they are released into the atmosphere.

The internal combustion engine arrangement 1 further comprises an additional fluid line 4 which carries a warm fluid. This fluid may be carried towards the engine 2, although this should not be considered as limitative. The additional fluid line 4, which is distinct from the exhaust line 3, can form a closed or an open circuit. For example, the additional fluid line 4 can comprise one of the following lines:

- an engine cooling line carrying a cooling fluid;
- a gearbox or engine lubricating line carrying a lubricant;
- an air line carrying warm air, for example warm and compressed air flowing from a compressor of a turbocharger assembly;
- an exhaust gas recirculation (EGR) line carrying exhaust gases, said line being distinct from the exhaust line 3.

In a preferred embodiment, the additional line is an EGR line having an upstream end connected to the exhaust line 3 and a downstream end connected to an intake line of the engine arrangement. Through such an EGR line, a portion of the exhaust gases produced by the combustion inside the engine are recirculated to the engine rather than being released the atmosphere. The EGR gases which are fed to the engine allow modifying the temperature and the composition of the gases inside the engine, thus modifying the conditions of the combustion.

The internal combustion engine arrangement 1 further comprises a waste heat recovery system 5 carrying a working fluid in a closed loop. Such a waste heat recovery system preferably converts the heat energy of the working fluid into mechanical energy or power. The waste heat recovery system preferably operates thanks to a working fluid, distinct from the exhaust gases, which is heated by the exhaust gases in a heat exchanger, and which is expanded in an expander where the energy of the working fluid is converted into mechanical energy. In the illustrated embodiment, the waste heat recovery system 5 is of the Rankine type, meaning that it operates according to the Rankine thermodynamic cycle. However, other types of waste heat recovery systems are possible, provided they form a closed loop and involve a phase change, such as a Kalina system.

In the closed loop, the working fluid is successively pressurized from a low pressure circuit portion to a high pressure circuit portion by a pump 13, evaporated in the high pressure circuit portion, expanded in an expander 14 from the high pressure circuit portion to a low pressure circuit portion, and condensed in a condenser 15 in the low pressure circuit portion. The waste heat recovery system 5 further comprises a first and a second lines 11, 12 arranged in parallel in the high pressure circuit portion upstream of the expander 14, the first and second lines joining at a downstream junction point 8 in the high pressure circuit portion upstream of the expander 14.

In the exemplary embodiment shown in the figures, the waste heat recovery system 5 comprises:

- a common line 6, and
- a first line 11 and a second line 12 arranged in parallel, branching off from the common line 6 at an upstream junction point 7 and returning to the common line 6 at a downstream junction point 8.

At the upstream junction point 7 can be arranged a control valve 9, which can be a proportional three-way valve.

At the downstream junction point 8 can be provided a device 10 allowing to connect the first and second lines 11, 2 to the common line 6 and to mix the working fluids coming from said first and second lines 11, 12.

In this embodiment, the flow of fluid in an upstream portion of the common line is divided at the upstream junction point in two sub-flows, one flowing in the first line and one flowing in the second, line, and the two sub-flows may be mixed at the downstream junction point in a downstream portion of the common line. In this embodiment the first and second line replace the common line between the upstream and downstream junction points.

In the shown embodiment, the common line exhibits a high-pressure downstream portion which extends between the downstream junction point and the expander, so that both fluid flows from the first fluid flow and from the second fluid flow expand in the same expander 14.

The working fluid flowing in the waste heat recovery system 5 undergoes the following successive processes.

In the common line 6, the working fluid, which is a liquid at this stage, is pressurized from low to high pressure by means of the pump 13. The working fluid can be pressurized from the low pressure circuit portion to the high pressure circuit portion by several pumps, e.g. two pumps in series or two pumps in two parallel lines.

Further downstream, the working fluid is directed to the first line 11 and/or to the second line 12. Thus, the flow rate Q of the working fluid in the common line 6 can be divided into a sub flow rate Q1 of the working fluid in the first line 11 and a sub flow rate Q2 of the working fluid in the second line 12, by means of the control valve 9, which can regulate Q1 and Q2.

The first line 11 comprises a first heat exchanger 21 thermally connected to the exhaust line 3, in which the working fluid can be heated by means of the exhaust gases. There may be several heat exchangers in series and/or in parallel in the first line. The first heat exchanger may be a boiler where, upon nominal operation of the system, the working fluid is evaporated. The second line 12 comprises a second heat exchanger 22 thermally connected to the additional fluid line 4, in which the working fluid can be evaporated by means of the warm fluid. There may be several heat exchangers in series and/or in parallel in the second line. The second heat exchanger may be a boiler where, upon nominal operation of the system, the working fluid is evaporated.

It has to be noted that other implementations of the closed loop could be envisaged. For example, the upstream junction point could be located upstream from the pump, in the low pressure circuit portion. In this case, one pump can be arranged in each of the first and second lines.

In the figures, the second heat exchanger 22 is located, on the additional fluid line 4, upstream from the engine 2. However, other implementations are possible. For example, in case the additional fluid line 4 is an engine lubricating line or an engine cooling line, the second heat exchanger 22 could be located just at the output of the engine 2.

The gaseous working fluid from the first line 11 and/or the second line 12 can then continue to the common line 6 and enter an expander 14, in which it is expanded. The expander 14 can comprise for example a turbine, a piston expander, a screw expander, etc. . . . capable of converting part of the energy of the working fluid into mechanical energy, for example in the form of movement of a mechanical member of the expander The expander may have several expansion stages.

Downstream from the expander 14, the gaseous working fluid, which has been expanded to a lower pressure and cooled, can flow towards a condenser 5 in which it becomes a liquid again, before being directed back to the pump 13.

A tank 16 can further be provided in the common line 6, between the condenser 15 and the pump 13.

The circuit can therefore be considered to comprise a high pressure portion circuit, which extends, in the flow direction of the working fluid, between the pump (meaning the pumps in case of several pumps arranged in parallel) and the expander, and a low pressure portion circuit, which extends, in the flow direction of the working fluid, between the expander and the pump (meaning the pumps in case of several pumps arranged in parallel).

Therefore, in the shown embodiment, the first and second lines 11, 12 are arranged in the high pressure circuit portion, in parallel, between the pump 13 and the expander 14. Having two heat exchangers 21, 22 arranged in parallel and two hot sources allow the waste heat recovery system to be activated in a larger number of situations and ultimately makes it possible to increase the waste heat recovery system efficiency.

Nevertheless, in some operating conditions, the working fluid flowing out of the first heat exchanger 21 and/or the working fluid flowing out of the second heat exchanger 22 may not be fully evaporated. To avoid feeding the expander 14 with a fluid still containing liquid, which could greatly the expander 14, the engine arrangement 1 according to the invention includes:

- a first by-pass system designed to prevent not fully evaporated working fluid from the first line 21 to flow through the expander 14;
- and a second by-pass system designed to prevent not fully evaporated working fluid from the second line 22 to flow through the expander 14.

The first and second by-pass systems can be fully distinct or have some common parts. However, according to the invention, it is important for the first and second by-pass systems to be arranged so that, in case the working fluid from the second line 12 is not fully evaporated, and thus the second bypass system is activated, the working fluid from the first line 11 can still be directed to the expander 14 if it is fully evaporated or under superheated vapour form. This brings one significant advantage of the invention, namely the possibility of partially feeding the expander 14, rather than not feeding it at all, in some operating conditions.

To that end, the second by-pass system connects the second line 12 upstream of the downstream junction point 8, to the low pressure circuit portion, at a connecting point 24, for by-passing the downstream junction point 8 and the expander 14.

Owing to this disposition, in case the working fluid flowing out of the second heat exchanger 22 is directed to the connecting point 24, the working fluid flowing out of the first heat exchanger 21 can still be directed towards the expander 14.

In the illustrated embodiments, the second by-pass system comprises a by-pass valve 20 which is arranged in the second line 12 between the second heat exchanger 22 and the downstream junction point 8. This bypass valve 20 is capable of directing the flow of working fluid from the second heat exchanger 22:

- either through the second line 12 to the downstream junction point 8, so that it is expanded in the expander form where part of its energy is converted into mechanical form;
- or to the low pressure circuit portion, more precisely upstream of the condenser 15, so that said fluid by-passes the expander depending in particular on the condition of the working fluid in the second line 12, for example the working fluid flowing out of the second heat exchanger 22, in order to prevent not fully evaporated working fluid from flowing through the expander 14.

To that end, the second by-pass system can comprise a secondary line 23 which by-passes the expander 14 and connects the second line 12 upstream of the downstream junction point 8 to the connecting point 24, which is located in the low pressure circuit portion between the expander 14 and the condenser 15. Therefore, the by-pass valve 20 is capable of directing the flow of working fluid from the second heat exchanger 22, through the secondary line 23, that is distinct from the common line 6, to the connecting point 24 located on the common line 6 between the expander 14 and the condenser 15.

A three-way valve 25, more specifically an on-off three-way valve, may be provided at the connecting point 24.

In practice, the by-pass valve 20 can be a three-way valve having one first upstream port connected to an upstream portion of the second line 12, one second downstream port connected to a downstream portion of the second line 12, and one third downstream port connected to the secondary line 23, at the inlet thereof. In an implementation, the by-pass valve 20 can be an on-off three-way valve, meaning that all of the working fluid flowing out of the second heat exchanger 22 is directed either to the downstream junction point 8 or to the connecting point 24, no distribution of the flow rate Q1 being possible between the second line 12 and the secondary line 23.

Other valve systems could be provided, such as for example a first two way valve in the second line downstream of the junction line and a second two-way valve in the secondary line.

The engine arrangement 1 can further comprise a first determining device 31 for determining at least one physical parameter of the working fluid in the first line 11, for example between the first heat exchanger 21 and the downstream junction point 8, and a first control unit 41 operatively connected to the first determining device 31 for controlling the activation of the first by-pass system. The physical parameter can comprise one or several of the temperature T1, the pressure P1 and the sub flow rate Q1 of the working fluid in the first line 11.

Thus, in case, on the basis of said physical parameter(s), it is determined that the working fluid in the first line 11 is not fully evaporated, then the control unit 41 may be configured to activate the first by-pass system in order to prevent said working fluid from flowing through the expander 14.

The engine arrangement 1 can further comprise a second determining device 32 for determining at least one physical parameter of the working fluid in the second line 12 For example a temperature sensor can be located at the exit of the second heat exchanger 22, for example between the second heat exchanger 22 and the by-pass valve 20. A second control unit 42 may be operatively connected to the second determining device 32 for controlling the by-pass valve 20 as a function of said physical parameter(s).

The physical parameter can comprise one or several of the temperature T2, the pressure P2 and the sub flow rate Q2 of the working fluid in the first line 12.

Thus, when imposed by the operating conditions of the engine arrangement, the second by-pass system can be activated, meaning that the by-pass valve 20 directs the working fluid flowing out of the second heat exchanger 22 into the secondary line 23, in order to prevent not fully evaporated working fluid from flowing through the expander 14.

Physical parameters, such temperatures T1 and T2, can either be measured by an appropriate sensor or be calculated using other available measured data in the engine arrangement 1.

According to a possible implementation of the invention, the activation of the second by-pass system, by the second control unit 42, may be implemented as follows: the working fluid flowing out of the second heat exchanger 22 by-passes the expander 14, i.e. is directed through the secondary line 23, in case it is determined, on the basis of said physical parameter(s), that the working fluid in the second line 12 is not fully evaporated. Otherwise, the second by-pass system is not activated, meaning that the working fluid flowing out of the second heat exchanger 22 is directed towards the downstream junction point 8, and then towards the expander 14.

According to another possible implementation of the invention, the activation of the second by-pass system, by the second control unit 42, may be implemented as follows: in case it is determined, on the basis of said physical parameter(s), that the working fluid in the second line 12 is not fully evaporated, the process further comprises:

determining if mixing of the working fluid from the first line 11 with the working fluid from the second line 12 first flow would result in the resulting mixed flow being fully evaporated or under the form of superheated vapour;

and, if so, controlling the first and second bypass systems so that the working fluid from the first and second lines 11, 12 are mixed at the downstream junction point and so that the resulting mixed flow is expanded in the expander 14.

In other words, even if the working fluid flowing out of the second heat exchanger 22 is not fully evaporated, it can still be directed towards the expander 14—i.e. the second by-pass system is not activated—if the state of the working fluid flow in the first line 11 ultimately allows getting the working fluid of the second line 12 to a fully evaporated or superheated vapour state. To that end, the second control unit 42 may further be operatively connected to the first determining device 31.

This is an advantageous implementation of the invention in that it makes it possible to fully use the heat transferred to the working fluid by the hot sources to recover energy at the expander 14. The flow of evaporated or superheated vapour working fluid at the expander inlet is indeed higher than if the second by-pass system was activated.

In this implementation, it could be envisaged that the by-pass valve 20 is a proportional three-way valve, to direct towards the downstream junction point 8 only the amount of working fluid from the second line 12 that can be superheated by the working fluid from the first line 1.

The engine arrangement 1 can comprise further control systems, such as:

a control system for controlling the flow rate Q2 of working fluid in the second line 12, in order to regulate the temperature T4 of the warm fluid in the additional fluid line 4, between the second heat exchanger 22 and the engine 2. Practical implementations of such a control system will be described hereafter;

a control system for controlling the flow rate Q1 of working fluid in the first line 11, in order to regulate the temperature T1 of the working fluid in the first line 11, between the first heat exchanger 21 and the downstream junction point 8, in particular as a function of the flow rate and temperature of the exhaust gases in the exhaust line 3, upstream from the first heat exchanger 21.

Besides, there may be provided means to expand the working fluid in case the expander 14 is by-passed. More precisely, the engine arrangement 1 can comprise at least one pressure reducing valve located upstream from the condenser 15, and capable of reducing the pressure of the working fluid not having flown through the expander 14 before it enters the condenser 15. Such a pressure reducing valve can comprise a calibrated orifice, which may be controlled or not. It does not convert the energy of the working fluid into mechanical energy.

Several embodiments of the engine arrangement 1 will now be described.

According to an implementation of the invention, the first by-pass system comprises a first by-pass line 51 having an inlet 53 located between the first heat exchanger 21 and the expander 14, and more precisely between the downstream junction point 8 and the expander 14, and an outlet 54 located in the low pressure circuit portion, between the expander 14 and the condenser 15. Preventing the working fluid flowing from the first line 11 from flowing through the expander 14 is achieved by directing the working fluid into the first by-pass line 51. In other words, the first by-pass system is then a by-pass of the expander 14.

A three-way valve 28, more specifically an on-off three-way valve, may be provided at the first by-pass line inlet 53. In practice, this three-way valve 28 has one first upstream port connected to an upstream portion of the common line 6, one second downstream port connected to a downstream portion of the common line 6, and one third downstream port connected to the first by-pass line 51.

Figure 2:
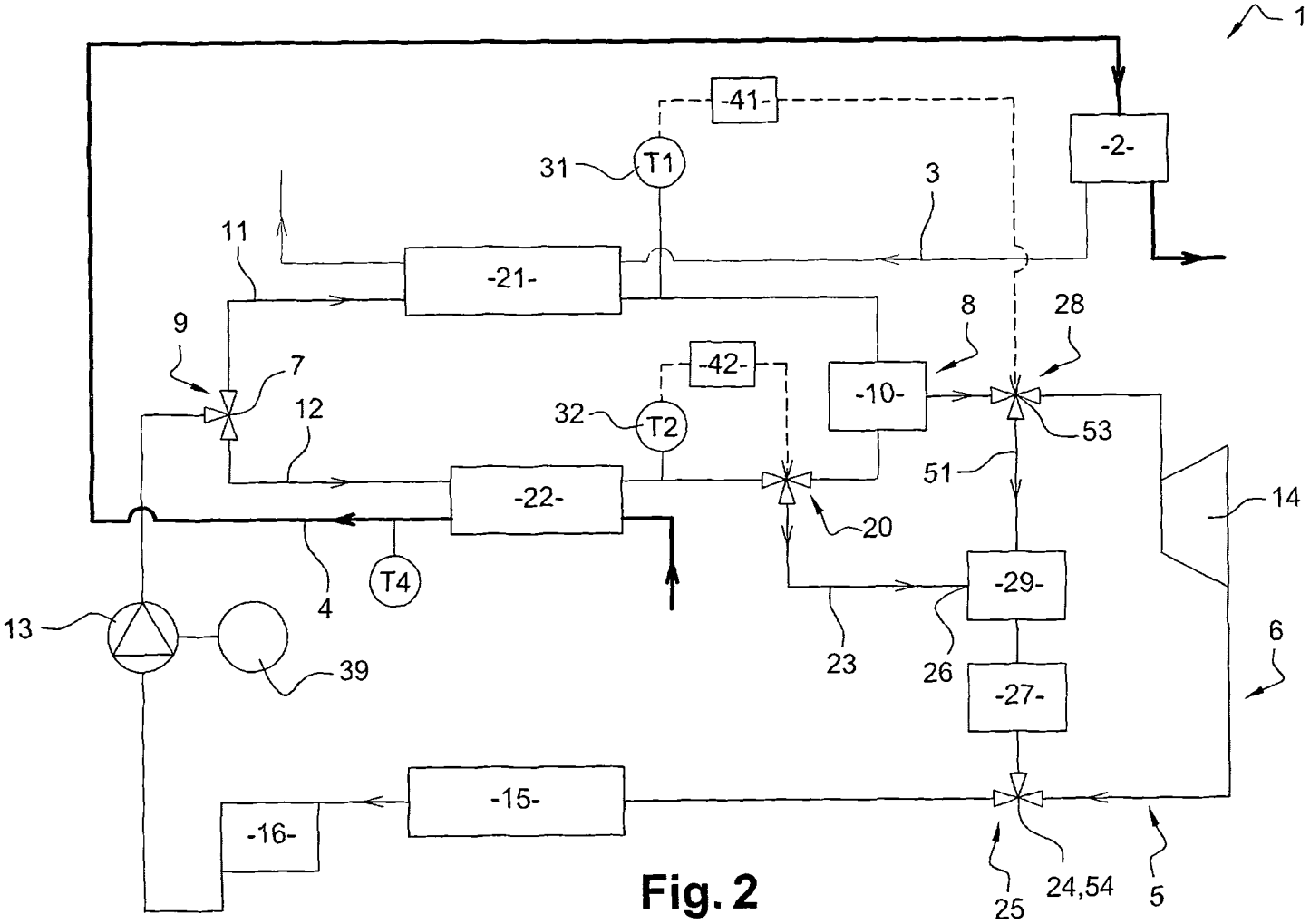
FIG. 2 is a schematic drawing of an of an engine arrangement according to a second embodiment of the invention.
Figure 3:
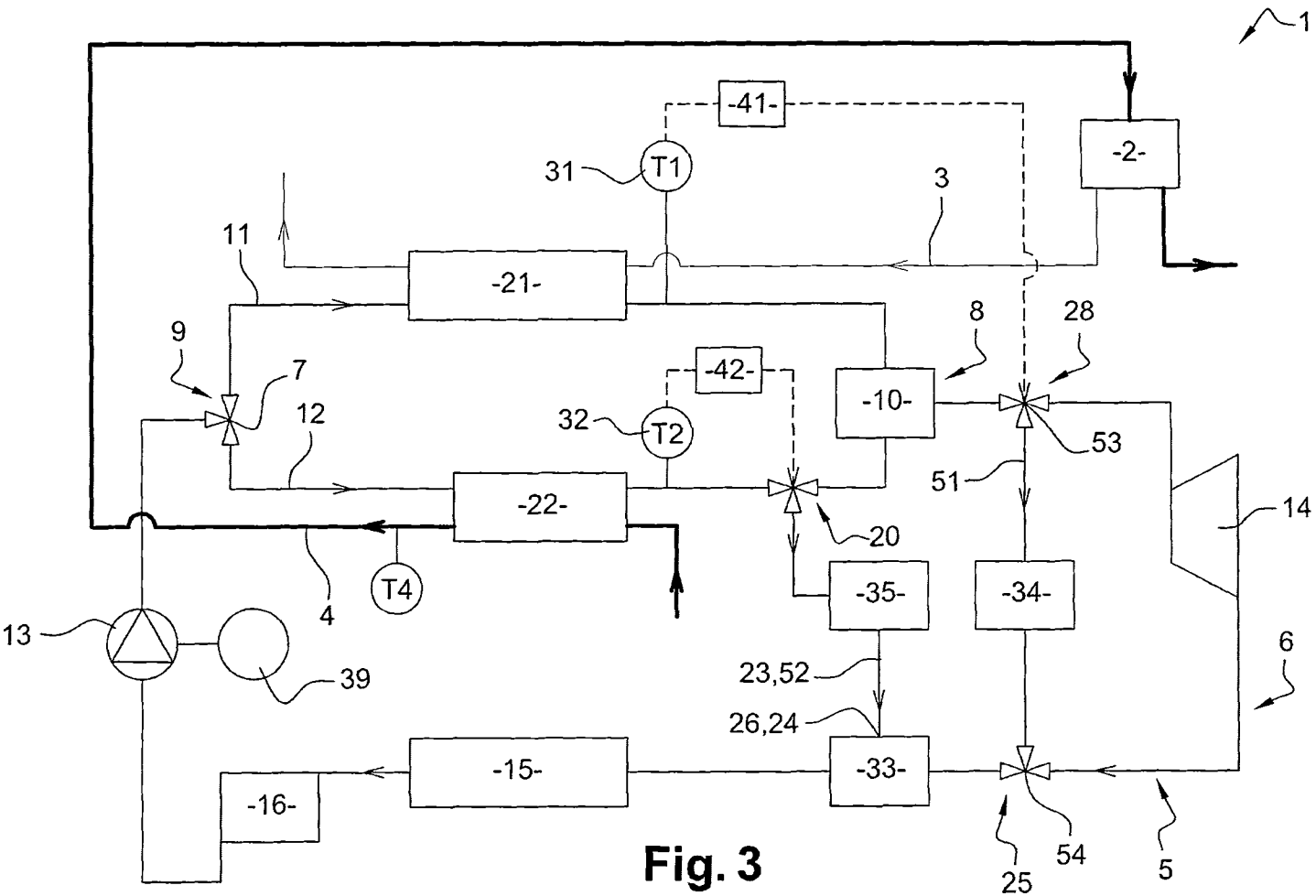
FIG. 3 is a schematic drawing of an of an engine arrangement according to a third embodiment of the invention.

Corresponding first, second and third embodiments of this implementation are shown respectively in FIGS. 1, 2 and 3.

In a first embodiment, shown in FIG. 1, the outlet 26 of the secondary line 23 is connected to the first by-pass line 51, between the inlet 53 and the outlet 54 of said first by-pass line 51, so that the connecting point 24 and the outlet 54 of the first by-pass line 51 coincide. Thus, downstream from the outlet 26 of the secondary line 23, the working fluid flowing from the first line 11 and the working fluid flowing from the second line 12 are carried by a same line up to the connecting point 24—or outlet 54 of the first by-pass line 51.

The three-way valve 25 located at the outlet 54 of the first by-pass line 51 has one first upstream port connected to the first by-pass line 51, one second upstream port connected to an upstream portion of the common line 6, and one third downstream port connected to a downstream portion of the common line 6.

The engine arrangement 1 may comprise a common pressure reducing valve 27 located in the first by-pass line 51 between the secondary line outlet 26 and the first by-pass line outlet 54. For example, this common pressure reducing valve 27 can be located substantially at the junction between the secondary line 23 and the first by-pass line 51, i.e. near the secondary line outlet 26. This common valve 27 is used to expand the working fluid which has not flown through the expander 14, whether the working fluid flows from the first line 11 or from the second line 12. It does not convert the energy of the working fluid into mechanical energy.

Alternatively, in a variant not shown, there can be provided a first pressure reducing valve arranged in the first by-pass line 51 and capable of reducing the pressure of the working fluid from the first line 11, and a second pressure reducing valve, distinct from the first pressure reducing valve, which is arranged in the secondary line 23 and is capable of reducing the pressure of the working fluid from the second line 12. It does not convert the energy of the working fluid into mechanical energy.

The second embodiment shown in FIG. 2 differs from the first embodiment in that the common pressure reducing valve 27 is located downstream from the secondary line outlet 26. At the secondary line outlet 26 can be arranged a device 29 allowing to connect the secondary line 23 and the first by-pass line 51 and to mix the working fluids coming from said lines 23, 51.

In a variant not shown, the three-way valve 28, device 29 and common pressure reducing valve 27 could be one and the same component capable of performing all the corresponding functions. In another variant, there can be provided a first pressure reducing valve arranged in the first by-pass line 51 and capable of reducing the pressure of the working fluid from the first line 11, and a second pressure reducing valve, distinct from the first pressure reducing valve, which is arranged in the secondary line 23 and is capable of reducing the pressure of the working fluid from the second line 12.

In the third embodiment shown in FIG. 3, the connecting point 24 coincides with the outlet 26 of the secondary line 23 and is distinct from the outlet 54 of the first by-pass line 51. Therefore, the secondary line 23 forms a second by-pass line 52 distinct from the first by-pass line 51. In the embodiment of FIG. 3, the waste heat recovery system 5 of the engine arrangement 1 comprises two completely separate by-pass systems.

At the secondary line outlet 26 can be arranged a device 33 allowing to connect the secondary line 23, an upstream portion of the common line 6, and a downstream portion of the common line 6, and to mix the working fluids coming from the secondary line 23 and the common line 6.

In this embodiment, the engine arrangement 1 can comprise:

- a first pressure reducing valve 34 arranged in the first by-pass line 51 and capable of reducing the pressure of the working fluid from the first line 11;
- and a second pressure reducing valve 35, distinct from the first pressure reducing valve 34, which is arranged in the secondary line 23—i.e. the second by-pass line 52—and is capable of reducing the pressure of the working fluid from the second line 12.

Figure 4:
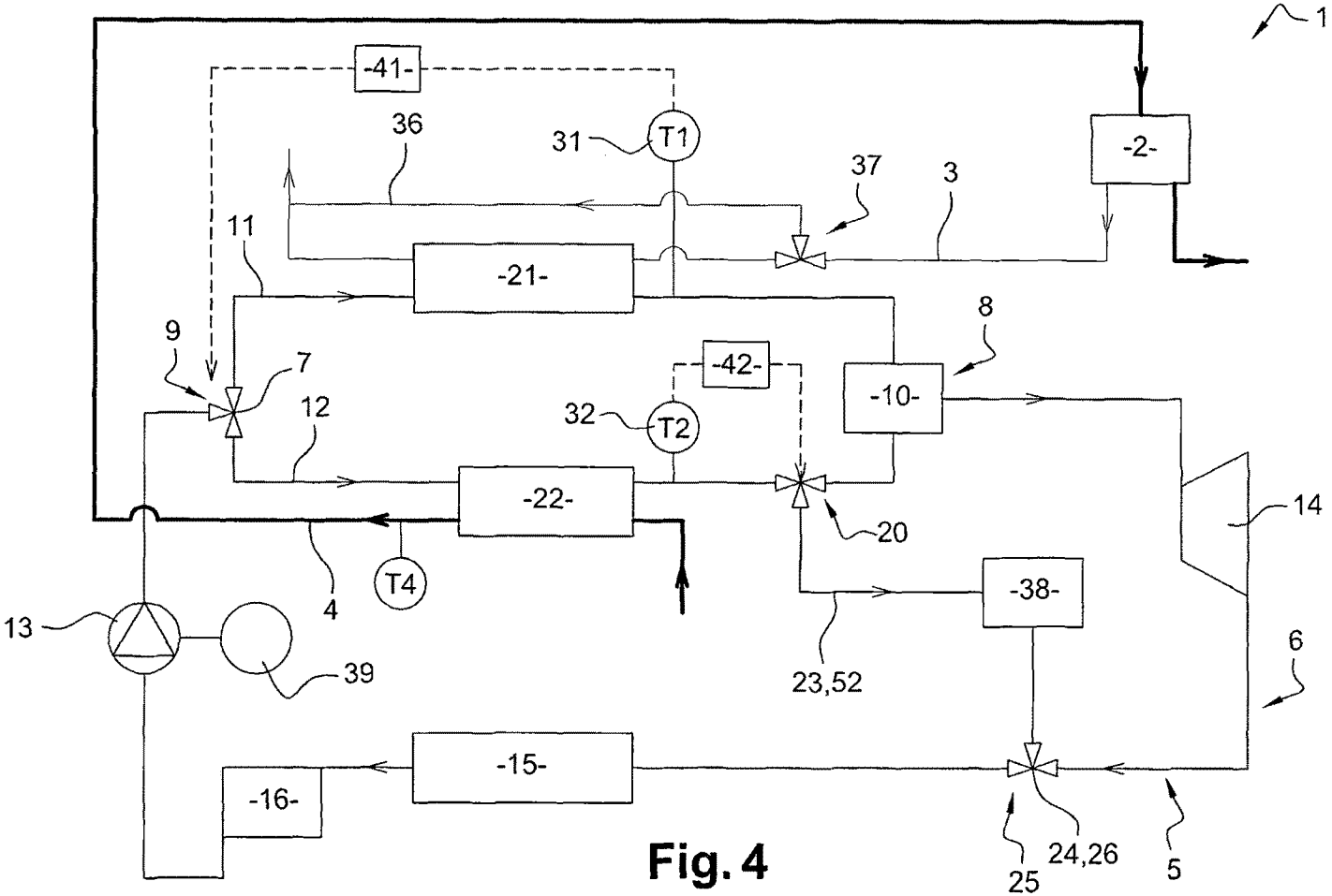
FIG. 4 is a schematic drawing of an of an engine arrangement according to a fourth embodiment of the invention.

Reference is made to FIG. 4 which shows a fourth embodiment of the engine arrangement 1 according to the invention.

According to this fourth embodiment, the first by-pass system comprises a control valve which is arranged in the first line 1, upstream from the first heat exchanger 21, and which is capable of preventing the working fluid from flowing into the first heat exchanger 21. In practice, said control valve can be the control valve 9 arranged at the upstream junction point 7. This control valve 9 is capable of regulating not only the sub flow rate Q1 of the working fluid in the first line 11, but also the sub flow rate Q2 of the working fluid in the second line 12.

Preventing the working fluid flowing from the first line 11 from flowing through the expander 14 is achieved by actuating the control valve 9, in order to prevent the working fluid from flowing into the first heat exchanger 21. In other words, the first by-pass system is a then a system allowing the working fluid to by-pass the first heat exchanger 21.

The first control unit 41, that is operatively connected to the first determining device 31 which determines at least one physical parameter of the working fluid in the first line 11, controls the activation of the first by-pass system by controlling the control valve 9.

The engine arrangement 1 can further comprise a derivation line 36 into which the exhaust gases can flow so as to by-pass the first heat exchanger 21, and a valve 37—for example a proportional three-way valve—for controlling the flow of exhaust gases in said derivation line 36. This disposition makes it possible to protect the first heat exchanger 21, by ensuring that, when no working fluid flows through the first heat exchanger 21, no exhaust gases either flow through the first heat exchanger 21. This can typically happen in the engine start-up phase, when the temperature of the exhaust gases is not high enough to cause a superheating of the working fluid.

As the first by-pass system comprises a system allowing the working fluid to by-pass the first heat exchanger 21, the engine arrangement 1 can be devoid of any line joining:

- a point located between the first heat exchanger 21 and the expander 14
- to the low pressure circuit portion, here a low pressure portion of the common line 6, downstream from the expander 14, to allow the working fluid from the first line 11 to by-pass the expander 14.

Typically, such a missing line could branch from the common line 6 between the downstream junction point 8 and the expander 14, as the first bypass line 51 depicted in FIGS. 1 to 3.

In this fourth embodiment, the secondary line 23 forms a second by-pass line 52 having an outlet 26 which coincides with the connecting point 24, and at which is provided the three-way valve 25.

A pressure reducing valve 38 is arranged in the second by-pass line 52 for reducing the pressure of the working fluid from the second line 12, that has not flown through the expander 14.

As previously described, the engine arrangement 1 can comprise a control system for controlling the flow rate Q2 of working fluid in the second line 12, in order to regulate the temperature T4 of the warm fluid in the additional fluid line 4, between the second heat exchanger 22 and the engine 2.

In the embodiments depicted in FIGS. 1 to 4, this control system comprises an electric motor 39 capable of driving the pump 13, and a proportional three way valve designed to regulate the sub flow rates Q1, Q2 of the working fluid in the first and second lines 11, 12. Said proportional three way valve can be located at the upstream junction point: it is then constituted by the control valve 9.

Owing to the electrically driven pump 13, the global flow rate Q of the working fluid can be regulated, while the control valve 9 allows regulating the sub flow rates Q1, Q2 of the working fluid respectively in the first and second lines 11, 12. Alternatively, the control valve 9 could be replaced by other components allowing regulating Q1 and Q2, such as two pumps.

Figure 5:
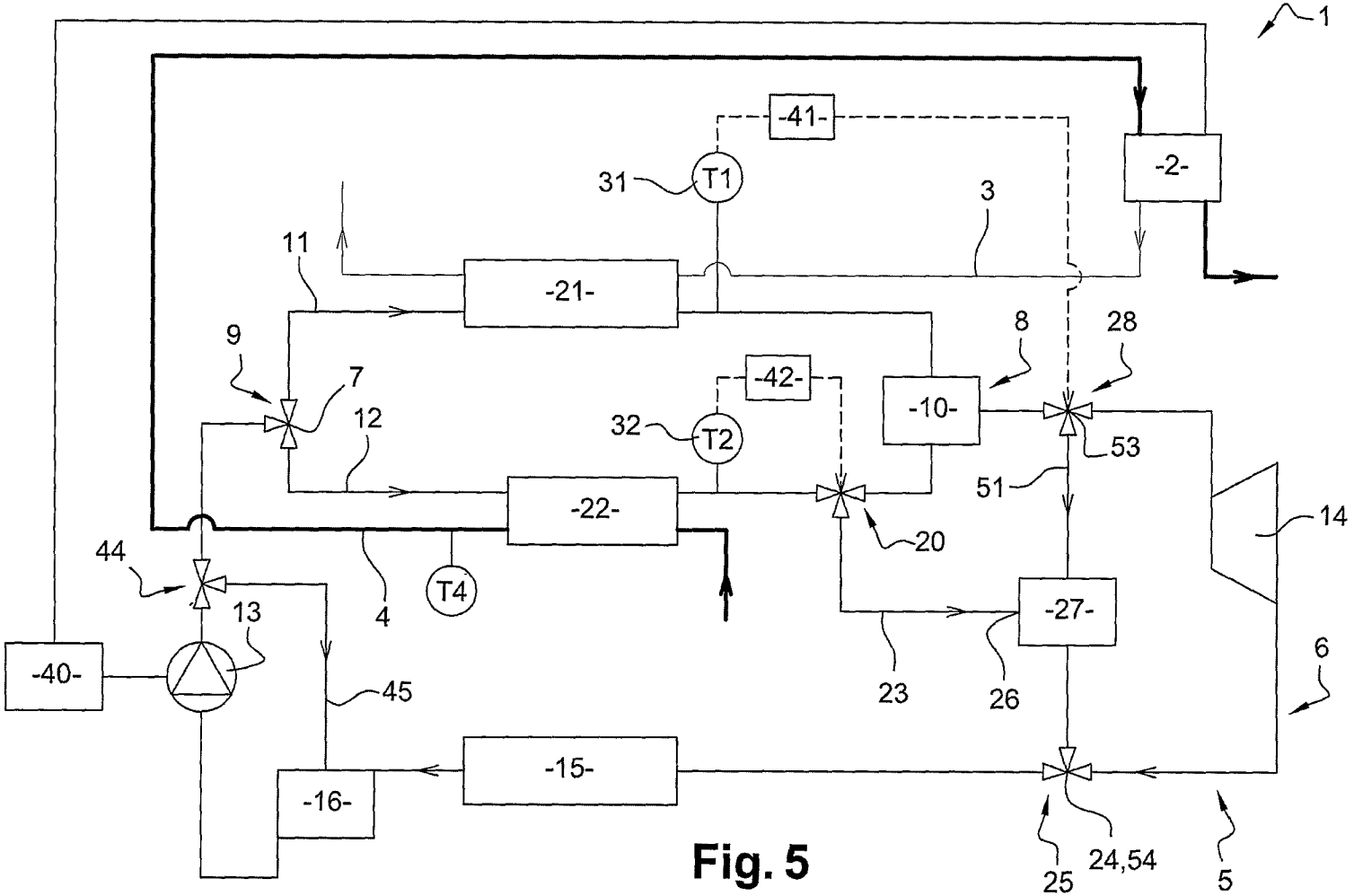
FIG. 5 is a schematic drawing of an of an engine arrangement according to a fifth embodiment of the invention.

FIG. 5 shows a fifth embodiment of the invention, in which the control system for controlling the flow rate Q2 is different.

More precisely, in this fifth embodiment, the pump 13 is mechanically driven by the internal combustion engine 2, by means of a mechanical transmission assembly 40. The control system further comprises an additional proportional three way valve 44 located between the pump 13 and the second heat exchanger 22 and having a port connected to the common line 6, between the condenser 15 and the pump 13, through a return line 45. Typically, the return line 45 can have an outlet opening in the tank 16.

As the pump 13 is mechanically driven by the engine 2, the flow rate Q of the working fluid downstream from the pump cannot be regulated. In practice, said flow rate Q is set to a maximum value which is predetermined in order to be sufficient in the highest operating conditions. Thus, controlling Q2 is achieved by means, of the additional proportional three way valve 44. This valve 44 directs the quantity of working fluid in surplus—i.e. which would lead to a too important cooling of the warm fluid in the additional fluid line 4—back towards the pump inlet.

As shown in FIG. 5, the additional proportional three way valve 44 can be located in the common line 6, between the pump 13 and the upstream junction point 7. However, other implementations are possible. For example, the valve 44 could be located in the second line 12, between the upstream junction point 7 and the second heat exchanger 22.

Apart from this, the engine arrangement 1 shown in FIG. 5 is similar to the one described with reference to FIG. 1. However, other variants could be envisaged, such as the one shown in any one of FIGS. 2 to 4.

The invention is of course not limited to the embodiments described above as examples, but encompasses all technical equivalents and alternatives of the means described as well as combinations thereof.

In particular, it has to be noted that the specific features of the various described embodiments could be mixed to create new possible embodiments. For example, a mechanically driven pump could replace the electrically driven pump in any of FIGS. 1 to 4. Besides, in a given embodiment, a first by-pass system described as a system allowing the working fluid of the first line to by-pass the expander could be replaced by a system allowing the working fluid to by-pass the first heat exchanger, and vice versa.

The invention claimed is:

1. An internal combustion engine arrangement, comprising:

an internal combustion engine;

an exhaust line collecting exhaust gases from the engine;

an additional fluid line, distinct from the exhaust line, carrying a warm fluid;

a waste heat recovery system carrying a working fluid in a closed loop, in which the working fluid is successively pressurized from a low pressure circuit portion to a high pressure circuit portion by a pump, evaporated in the high pressure circuit portion, expanded in an expander from the high pressure circuit portion to a low pressure circuit portion, and condensed in a condenser in the low pressure circuit portion, the waste heat recovery system comprising a first and a second lines arranged in parallel in the high pressure circuit portion upstream of the expander, the first and second lines joining at a downstream junction point in the high pressure circuit portion upstream of the expander, wherein the first line comprises a first heat exchanger thermally connected to the exhaust line, in which the working fluid can be heated by means of the exhaust gases, and the second line comprises a second heat exchanger thermally connected to the additional fluid line, in which the working fluid can be heated by means of the warm fluid;

wherein it further comprises:

a first by-pass system designed to prevent not fully evaporated working fluid from the first line to flow through the expander;

a second by-pass system which connects the second line upstream of the downstream junction point, to the low pressure circuit portion, at a connecting point, for by-passing the downstream junction point and the expander.

2. The engine arrangement according to claim 1, wherein the second by-pass system comprises at least one by-pass valve which is arranged in the second line between the second heat exchanger and the downstream junction point and which is capable of directing the flow of working fluid from the second heat exchanger either through the second line to the downstream junction point, or to the low pressure circuit portion.

3. The engine arrangement according to claim 1, wherein the second bypass system is connected to the low pressure circuit portion upstream of the condenser.

4. The engine arrangement according to claim 1, wherein the second bypass system comprises a secondary line which by-passes the expander and connects the second line upstream of the downstream junction point to a connecting point located in the low pressure circuit portion between the expander and the condenser.

5. The engine arrangement according to claim 2, wherein the by-pass valve comprises an on-off three-way valve.

6. The engine arrangement according to claim 1, wherein it comprises a determining device for determining at least one physical parameter of the working fluid in the second line, and a control unit operatively connected to the determining device for controlling the second by-pass system as a function of the physical parameter(s).

7. The engine arrangement according to claim 1, wherein it comprises at least one pressure reducing valve located upstream from the condenser, and capable of reducing the pressure of the working fluid not having flown through the expander before it enters the condenser.

8. The engine arrangement according to claim 1, wherein the first by-pass system comprises a first by-pass line having an inlet located between the first heat exchanger and the expander, and an outlet located in the low pressure circuit portion between the expander and the condenser.

9. The engine arrangement according to claim 8, wherein the outlet of the secondary line is connected to the first by-pass line, between the inlet and the outlet of the first by-pass line, so that the connecting point and the outlet of the first bypass line coincide.

10. The engine arrangement according to claim 8, wherein the connecting point coincides with the outlet of the secondary line and is distinct from the outlet of the first by-pass line, so that the secondary line forms a second by-pass line distinct from the first by-pass line.

11. The engine arrangement according to claim 7, wherein the first by-pass system comprises a first by-pass line having an inlet located between the first heat exchanger and the expander, and an outlet located in the low pressure circuit portion between the expander and the condenser, and the outlet of the secondary line is connected to the first by-pass line, between the inlet and the outlet of the first by-pass line, so that the connecting point and the outlet of the first bypass line coincide, and wherein the engine comprises a common pressure reducing valve located in the first by-pass line between the secondary line outlet and the first by-pass line outlet.

12. The engine arrangement according to claim 7, wherein the first by-pass system comprises a first by-pass line having an inlet located between the first heat exchanger and the expander, and an outlet located in the low pressure circuit portion between the expander and the condenser, and the outlet of the secondary line is connected to the first by-pass line, between the inlet and the outlet of the first by-pass line, so that the connecting point and the outlet of the first bypass line coincide, and wherein the engine comprises:

a first pressure reducing valve arranged in the first by-pass line and capable of reducing the pressure of the working fluid from the first line; and a second pressure reducing valve, distinct from the first pressure reducing valve, which is arranged in the secondary line and is capable of reducing the pressure of the working fluid from the second line.

13. The engine arrangement according to claim 1, wherein the first by-pass system comprises a control valve which is arranged in the first line, upstream from the first heat exchanger, and which is capable of preventing the working fluid from flowing into the first heat exchanger.

14. The engine arrangement according to claim 13, wherein it comprises a derivation line into which the exhaust gases can flow so as to by-pass the first heat exchanger, and a valve for controlling the flow of exhaust gases in the derivation line.

15. The engine arrangement according to claim 13, wherein it is devoid of any line joining a point located between the first heat exchanger and the expander to the low pressure circuit portion to allow the working fluid from the first line to by-pass the expander.

16. The engine arrangement according to claim 13, wherein the secondary line forms a second by-pass line having an outlet which coincides with the connecting point.

17. The engine arrangement according to claim 1, wherein it further comprises a control system for controlling the flow rate (Q2) of working fluid in the second line, in order to regulate the temperature (T4) of the warm fluid in the additional fluid line, between the second heat exchanger and the engine.

18. The engine arrangement according to claim 17, wherein the control system comprises an electric motor (39) capable of driving the pump, and a proportional three way valve designed to regulate the sub flow rates of the working fluid in the first and second lines.

19. The engine arrangement according to claim 17, wherein the pump is mechanically driven by the internal combustion engine, and in that the control system comprises an additional proportional three way valve located between the pump and the second heat exchanger and having a port connected to the low pressure circuit portion, between the condenser and the pump, through a return line.

20. The engine arrangement according to claim 19, wherein the additional proportional three way valve is located between the pump and an upstream junction point between the first and second lines.

21. The engine arrangement according to claim 1, wherein it further comprises a control system for controlling the flow rate (Q of working fluid in the first line, in order to regulate the temperature (T1) of the working fluid in the first line, between the first heat exchanger and the downstream junction point.

22. The engine arrangement according to claim 1, wherein the additional fluid line carrying a warm fluid is one of the following lines: an engine cooling line carrying a cooling fluid, a gearbox or engine lubricating line carrying a lubricant, an air line carrying warm air, an exhaust gas recirculation (EGR) line carrying exhaust gases.

23. The engine arrangement according to claim 1, wherein the waste heat recovery system is a Rankine system or a Kalina system.

24. A process for controlling a waste heat recovery system forming part of an internal combustion engine arrangement, the process comprising:

collecting exhaust gases from an internal combustion engine in an exhaust line;

carrying a warm fluid in an additional fluid line, distinct from the exhaust line;

carrying a working fluid in a closed loop, in which the working fluid is successively pressurized, evaporated, expanded in an expander to convert energy of the working fluid into mechanical energy or power, and condensed;

wherein the working fluid is divided into a first flow heated by the exhaust gases and into a separate second flow heated by the warm fluid, wherein the process further comprises:

determining at least one physical parameter of the working fluid in the first flow;

determining at least one physical parameter of the working fluid in the second flow;

when the first fluid flow is determined to be in a first fluid state and the second fluid flow is determined to be in a second fluid state, controlling a first bypass system so that the first fluid flow is expanded in the expander and controlling a second bypass system so that the second fluid flow by-passes the expander.

25. A process for controlling a waste heat recovery system forming part of an internal combustion engine arrangement, the process comprising:

collecting exhaust gases from an internal combustion engine in an exhaust line;

carrying a warm fluid in an additional fluid line, distinct from the exhaust line;

carrying a working fluid in a closed loop, in which the working fluid is successively pressurized, evaporated, expanded in an expander to convert energy of the working fluid into mechanical energy or power, and condensed;

wherein the working fluid is divided into a first flow heated by the exhaust gases and into a separate second flow heated by the warm fluid, wherein the process further comprises:

determining at least one physical parameter of the working fluid in the first flow;

determining at least one physical parameter of the working fluid in the second flow;

when the first fluid flow is determined to be in a first fluid state and the second fluid flow is determined to be in a second fluid state;

determining when mixing of the first flow with the second flow would result in the resulting mixed flow being in a first state;

and, when so, controlling a first bypass system and a second bypass system so that the first fluid flow is mixed with the second fluid flow and so that the resulting mixed flow is expanded in the expander.

26. The process according to claim 24, wherein it comprises, when the first fluid flow is determined to be in a first fluid state, controlling the first by-pass system so that the first fluid flow by-passes the expander.

27. The process according to claim 24, wherein it comprises, when the first fluid flow is determined to be in a first fluid state, controlling the first by-pass system so that the flow rate of the first fluid flow is zero.

28. The process according to claim 24, wherein the first fluid state is one of an evaporated and a superheated vapour state, and in that the second fluid state is a not fully evaporated state.

* * * * *